US006530401B1

(12) United States Patent
Angehrn et al.

(10) Patent No.: US 6,530,401 B1
(45) Date of Patent: Mar. 11, 2003

(54) METHOD FOR THE PRESERVATION OF AN OPENED DRINK BOTTLE

(75) Inventors: Martin Angehrn, Herisau (CH); Thomas Angehrn, Niederteufen (CH); Anton Boeni, Hombrechtikon (CH); Wolfgang Reichenberger, Rapperswil (CH)

(73) Assignee: Cash + Carry Angehrn AG, Gossau (CH)

( * ) Notice: Subject to any disclaimer, the term of this patent is extended or adjusted under 35 U.S.C. 154(b) by 0 days.

(21) Appl. No.: 10/049,184

(22) PCT Filed: Jul. 31, 2000

(86) PCT No.: PCT/CH00/00413

§ 371 (c)(1),
(2), (4) Date: Feb. 8, 2002

(87) PCT Pub. No.: WO01/12507

PCT Pub. Date: Feb. 22, 2001

(30) Foreign Application Priority Data

Aug. 16, 1999 (CH) ..... 1485/99

(51) Int. Cl.[7] ..... B65B 1/04

(52) U.S. Cl. ..... 141/64; 141/302; 222/5; 222/399; 261/DIG. 7; 220/366.1; 215/320

(58) Field of Search ..... 141/59, 64, 301, 141/302, 98, 65; 222/1, 3, 5, 399; 261/DIG. 7; 220/255, 366.1, 367.1; 215/311, 320

(56) References Cited

U.S. PATENT DOCUMENTS

| | | | | |
|---|---|---|---|---|
| 4,702,396 A | | 10/1987 | Gwiazda | |
| 4,763,803 A | | 8/1988 | Schneider | |
| 5,215,129 A | | 6/1993 | Berresford et al. | |
| 5,329,975 A | * | 7/1994 | Heitel | 141/19 |
| 5,396,934 A | * | 3/1995 | Moench | 141/5 |
| 5,458,165 A | * | 10/1995 | Liebmann, Jr. | 141/64 |
| 5,836,364 A | * | 11/1998 | Burton | 141/348 |
| 6,036,054 A | * | 3/2000 | Grill | 222/3 |

FOREIGN PATENT DOCUMENTS

| | | |
|---|---|---|
| EP | 0 234 607 | 11/1987 |
| FR | 2 526 762 | 11/1983 |

* cited by examiner

*Primary Examiner*—Steven O. Douglas
(74) *Attorney, Agent, or Firm*—Burns, Doane, Swecker & Mathis, LLP

(57) ABSTRACT

A device of the present invention includes a closure plug for a drink bottle. The plug is provided with an inlet and an inlet valve which is arranged therein and is embodied as a reflux valve that is closed in a rest position. The device also comprises a filling device which is provided with or can be connected to a filling head. The closure plug can be coupled to the filling head in a communicating manner. Gas can be inserted into the drink bottle by the filling device via the filling head and through the inlet valve of the closure plug. The filling head opens the inlet valve when the closure plug is coupled. The closure plug is provided with an outlet and an outlet valve that is arranged therein and is embodied as a reflux valve in the rest position.

18 Claims, 5 Drawing Sheets

METHOD FOR THE PRESERVATION OF AN OPENED DRINK BOTTLE

BACKGROUND OF THE INVENTION

1. Field of the Invention

The present invention relates to an appartaus for preserving the contents of a part-filled beverage bottle and to a stopper for a beverage bottle for use in the apparatus.

2. Background Information

Wine and champagne in part-filled bottles oxidise under the oxygen present in the normal ambient air, resulting in a rapid loss in quality. In the case of champagne, the natural liquid-bound $CO_2$ additionally escapes into the environment, making the champagne go flat which is likewise most undesirable.

U.S. Pat. No. 5,215,129, for example, discloses a system for preserving the contents of part-filled beverage bottles where the part-filled bottles of wine and champagne or sparkling wine are provided with a special stopper which either has an integrated non-return outlet valve (for wine bottles or generally for bottles with a so-called "still" content) or an integrated non-return inlet valve (for champagne and sparkling wine). The system has an application head to which the bottle stopper can be coupled in close communication when approached thereto. For wine bottles, the application head is an evacuation head which is connected to a suction pump. For champagne and sparkling wine bottles the application head is a charge head which is connected to a pressure pump. In a special embodiment the application head is both an evacuation and a charge head and is correspondingly connected to a suction and a pressure pump. When a bottle with the special stopper fixed thereto is coupled to the application head then, depending on whether the bottle is a wine bottle or a champagne or sparkling wine bottle, a control starts either the suction pump or the pressure pump and, in the case of wine, sucks air from the bottle via the outlet valve integrated in the stopper or, in the case of champagne or sparkling wine, presses air or $CO_2$ into the bottle via the inlet valve integrated in the stopper. Accordingly, subatmospheric pressure is created in the case of wine or still beverages, and superatmospheric pressure is created in the case of champagne or sparkling wine.

EP-A-0 234 607 discloses a similar but simpler system only for wine or other still beverages which likewise uses a special stopper but where the evacuation of the part-filled bottle closed with the special stopper is carried out by means of a hand pump.

Although the known systems preserve the quality of the beverages in the part-filled bottles for a relatively short period of time they cannot meet, in particular, high quality demands.

SUMMARY OF THE INVENTION

Starting from this state of the art, it is accordingly the object of this invention to improve the preservation of the quality of the contents of part-filled beverage bottles, the aim being not only to achieve, in particular, an prolongation of the preservation of the quality as compared to the customary methods but also to keep the per se unavoidable quality loss ensuing already from the opening of the bottle as small as possible.

According to the fundamental ideas of the present invention the gas volume above the liquid level in the beverage bottle is thus flushed and filled with nitrogen or a similar food-compatible gas and the bottle is then tightly closed and preferably kept under a slight overpressure. This brings the residual oxygen above the liquid level in the bottle down to the greatest possible minimum and the quality loss after the first opening of the bottle is thus virtually completely prevented even over an extended period of time.

Most suitable for expelling the ambient air or residual oxygen above the liquid level from the bottle is food quality nitrogen $N_2$. Nitrogen does not diffuse in liquids and therefore does not affect the taste of the liquid, wine or champagne. Nitrogen is available in sufficient amounts and at favourable conditions and can be transported and stored without danger.

FR-A-2 526 762 discloses a bottle stopper which can replace conventional corks in the necks of, for example, wine bottles in order to preserve their contents. This bottle stopper contains an exchangeable cartridge with nitrogen which is under pressure. Through the exertion of pressure on a control button an inlet valve in the stopper is opened through which nitrogen streams from the cartridge into the bottle. The air present above the liquid level in the bottle is expelled by this and is led out through the venting channels provided in the stopper. In the venting channels there are overpressure valves which are closed under normal atmospheric pressure. The replacement of air with nitrogen preserves the bottle contents.

U.S. Pat. No. 4,702,396 discloses a similar bottle stopper which is additionally a dispenser. In this case the nitrogen pressure cartridge, which is likewise exchangeable, is in constant communicating connection with the inside of the bottle, in the neck of which the stopper is inserted, via a pressure regulator and an inlet pipe and creates an overpressure in the bottle which is employed on the one hand to expel the air above the liquid level and on the other hand to withdraw the bottle contents. The air escapes through a vent pipe which is fitted with an outlet valve which can be opened manually. The liquid in the bottle flows out through a rising pipe reaching down to the bottom of the bottle and in which there is an output valve which can be manually operated.

Although the bottle stoppers described in FR-A-2 526 762 and in U.S. Pat. No. 4,702,396 are capable of preserving the contents of part-filled bottles, they are relatively complicated as stoppers and are therefore uneconomical for common use.

BRIEF DESCRIPTION OF THE DRAWINGS

The following drawings illustrate the invention in more detail. They show.

DETAILED DESCRIPTION OF THE PREFERRED EMBODIMENTS

Figure 1:
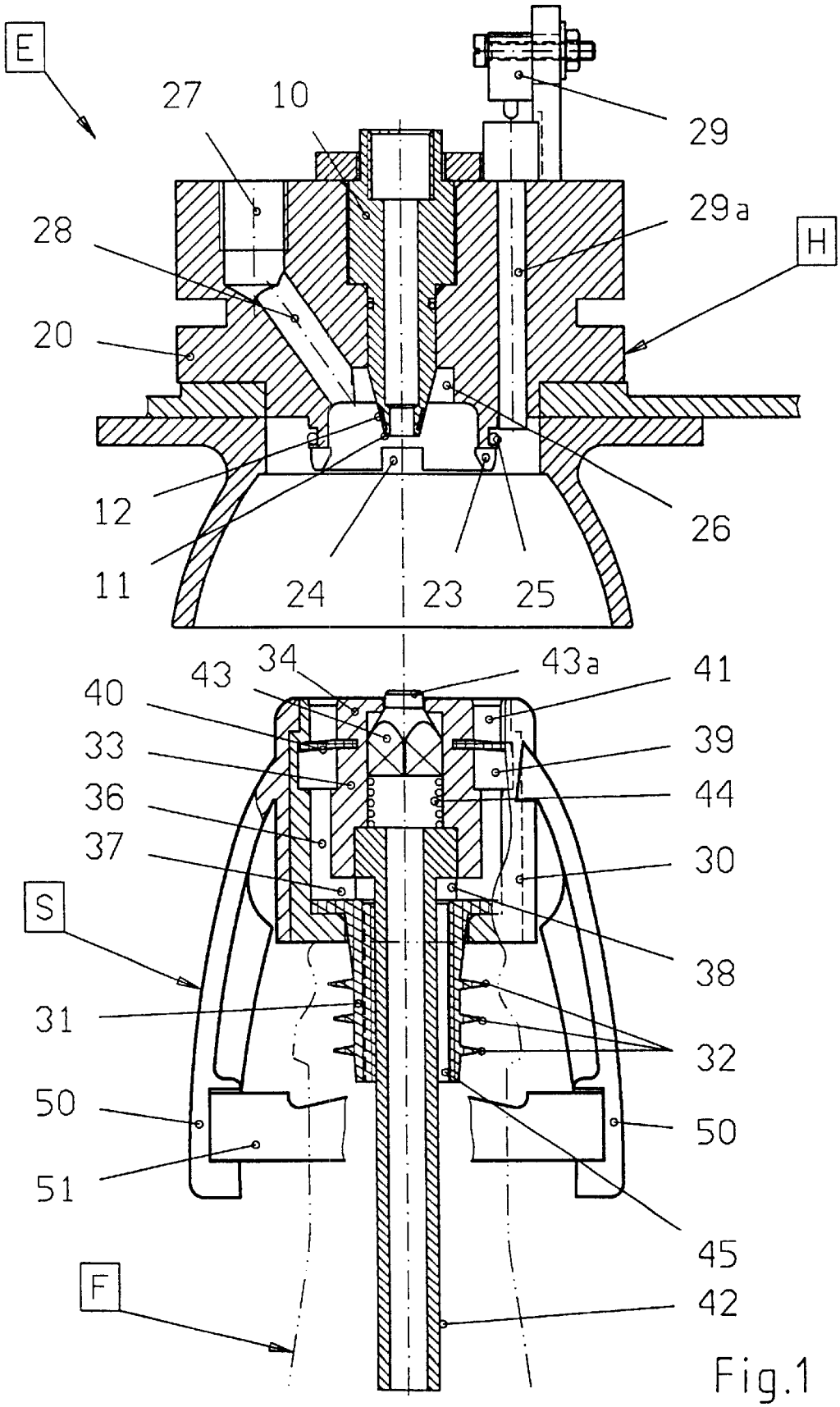
FIG. 1 a sectional drawing of the most essential components of a first embodiment of the inventive apparatus in the inactive state, FIG. 2 a sectional drawing of the first embodiment in the activated state, and FIG. 3 a sectional drawing of the most essential components of a second embodiment of the inventive apparatus in the inactive state, FIG. 4 a sectional drawing of the second embodiment in the activated state, and FIG. 5 an oblique drawing of an embodiment of the inventive bottle stopper.
Figure 2:
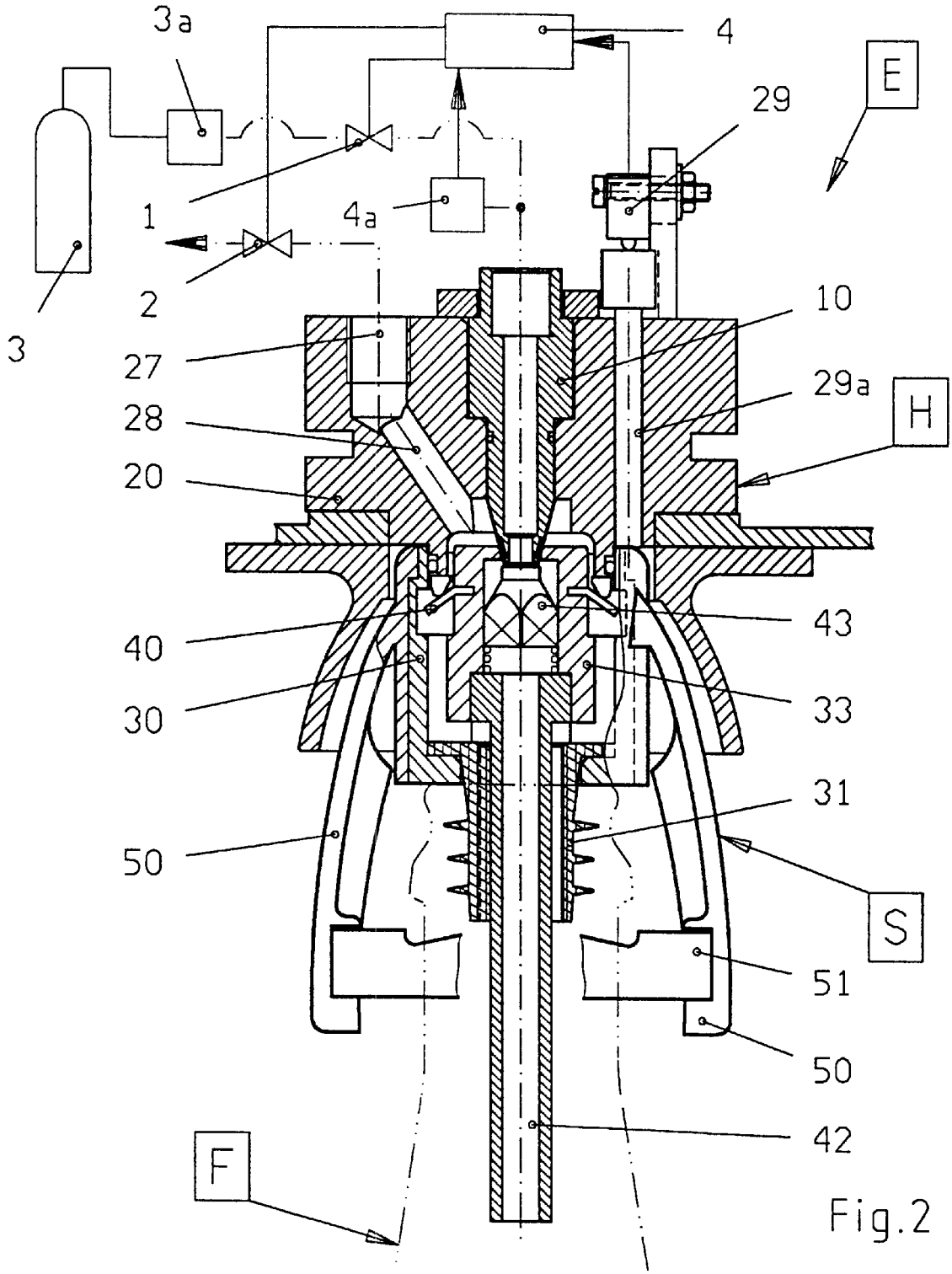
Figure 3:
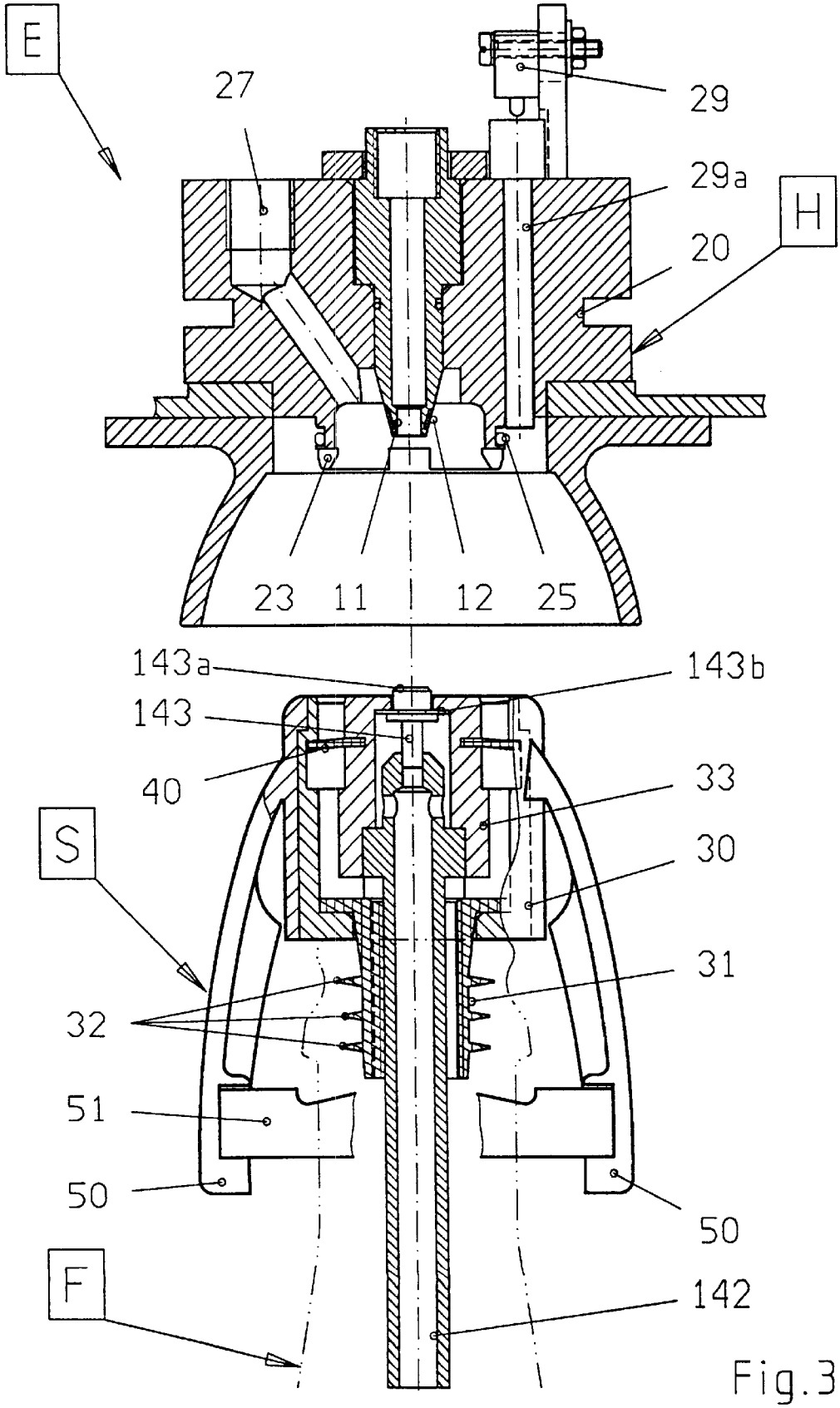
Figure 4:
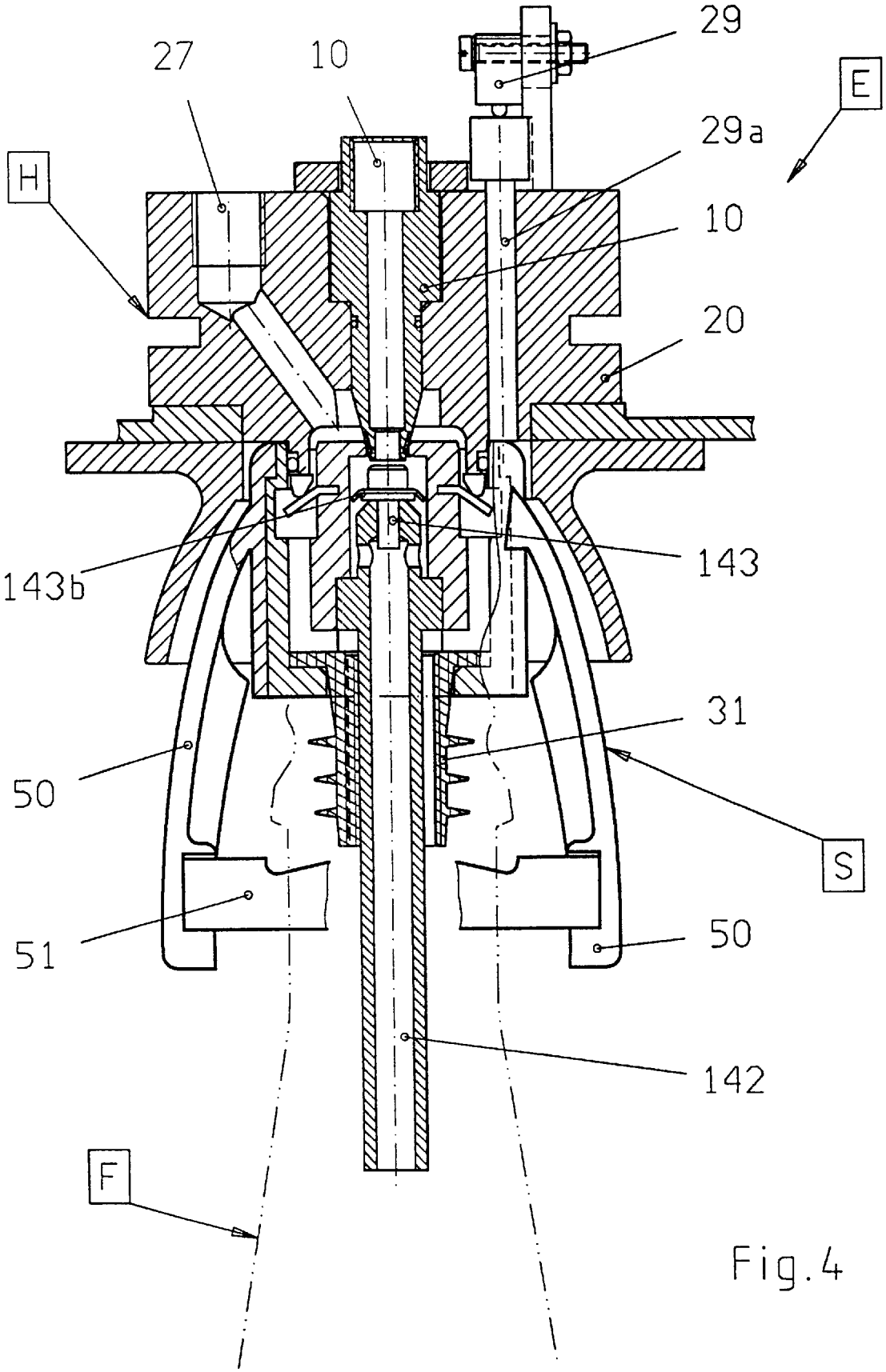

As may be seen from FIGS. 1 and 2, the apparatus essentially comprises at least one specially formed stopper, called S as a whole, and a charging device, called E as a whole. This latter in turn comprises a charge head which is called H as a whole and which is adapted to the stopper S, an inlet valve 1, a vent valve 2, a gas source 3 and an electric control 4 for controlling the two valves 1 and 2 as well as a pressure sensor 4*a* which cooperates with the control. Instead of the gas source 3 there could also be only a corresponding connection for the gas source 3. The gas source is typically a commercially available nitrogen bottle fitted with a pressure reducing valve 3*a* which is adjusted to an operating pressure of typically about 140 kPa (1.4 bar). In practice any number of stoppers S are of course possible which can cooperate with one and the same charging device E.

The charge head H comprises a mounting block 20 which is fixedly mounted or mountable and in which a charging pipe 10 is inserted such that it is essentially vertical in the depicted use position of the mounting block 20. At its upper end the charging pipe 10 is communicatingly connected via the inlet valve 1 with the gas source 3 or with the corresponding connection (FIG. 2). At its lower end according to the depicted use position the charging pipe 10 has a tapered axial prolongation 11. A joint ring 12 is arranged in the prolongation 11.

The mounting block 20 is provided at its bottom front end with a tubular collar 23 which is coaxial to the charging pipe 10 and which has at its bottom edge one or more than one aperture or wall recess 24. A joint ring 25 is arranged at the outer circumference of the collar 23.

In the bottom part of the mounting block 20 there is a drill hole 26 which is coaxial to the charging pipe 10 and the inside diameter of which is greater than the outside diameter of the charging pipe 10. At the upper side of the mounting block there is a connection 27 for the vent valve 2. This connection 27 is communicatingly connected with the drill hole 26 via an oblique drill hole 28. The connection 27, the oblique drill hole 28 and the interspace between the internal wall of the drill hole 26 and the external wall of the charging pipe 10 together form a venting channel which permeates the mounting block 20. The vent valve 2 is connected to the connection 27 (FIG. 2) or is arranged directly in it and when closed seals the venting channel to the outside.

On the mounting block 20 there is furthermore an electric switch (microswitch) 29 which can be actuated via a ram 29*a* which is mounted in the mounting block such that it slides. The ram 29*a* permeates the mounting block 20 and when at rest protrudes slightly from the bottom of the mounting block. The switch 29 is actuated by sliding the ram 29*a* in or up, and the resetting of the ram 29*a* to the bottom is effected through the return spring present in the switch and aided by the effect of gravity. The stopper S comprises an essentially approximately cup-shaped base body 30, in the perforated bottom of which a tubular stopper 31 is mounted which is made of an elastic material. At its outer circumference, the tubular stopper 31 is provided with elastic ring-shaped sealing ribs 32 which snuggle in a sealing manner to the internal wall of the neck of a beverage bottle F. The dimensions of the elastic tubular stopper 31 are of course adapted to the dimensions of the conventional wine and champagne bottles.

Figure 5:
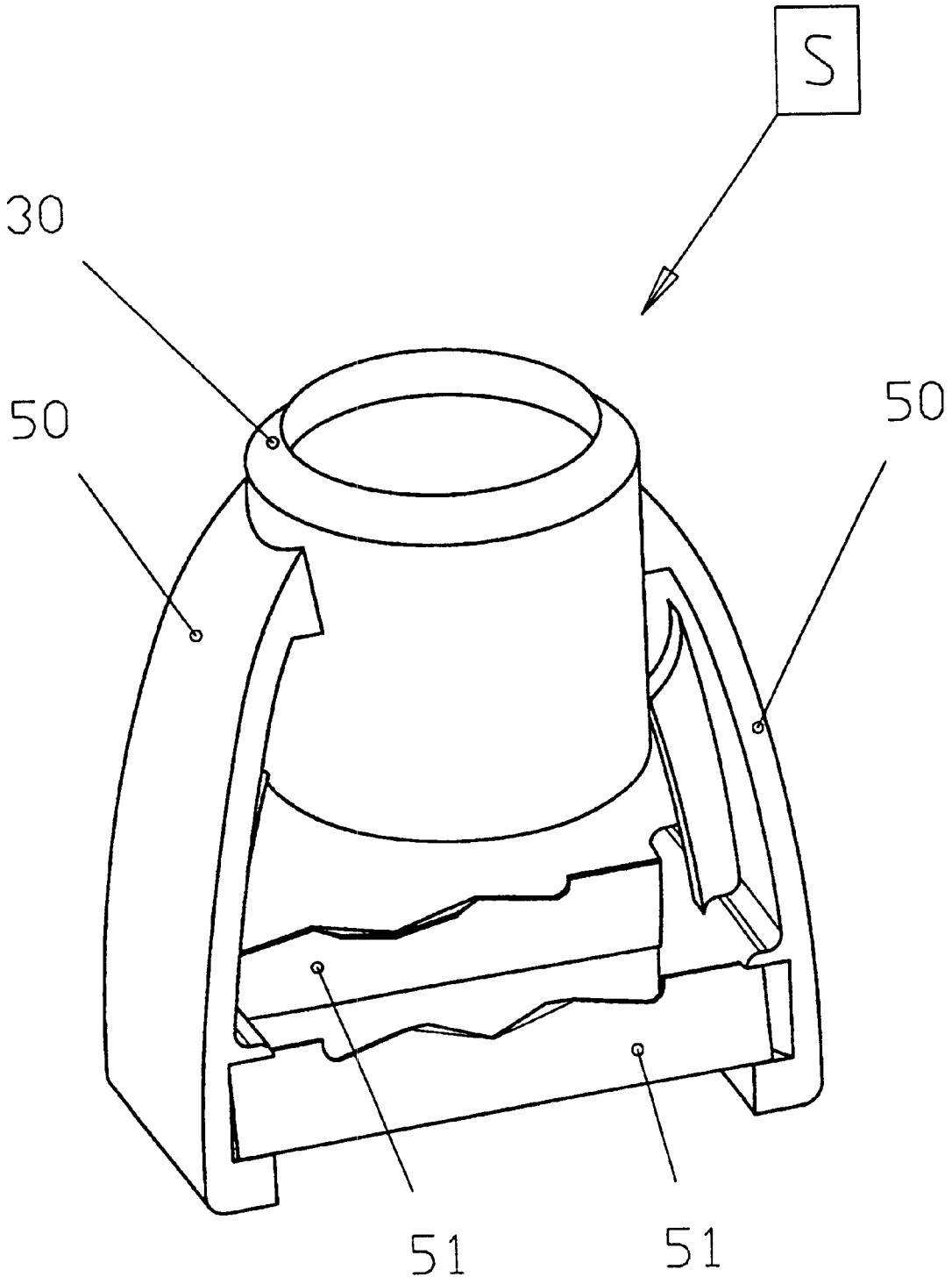

In order to securely arrest the stopper S on the neck of the beverage bottle F and thus to prevent an expulsion of the stopper due to overpressure in the bottle, the stopper is provided with special arresting devices. These comprise two relatively elastic bows 50 which are fixed to the base body 30 and two plate springs 51 which connect the two bows 50 and which are clamped in them. When the bottom ends of the two bows 50 are radially approached to each other the two plate springs 51 radially buckle apart from each other, as is known per se, e.g. from coin purses, so that the bottleneck can be passed through between them. When the two bows 50 are released the plate springs partly relax again, thereby closely embracing the bottleneck below the annular ridges usually present there, such that they grip behind those annular ridges and thus securely hold the stopper. To remove the stopper intentionally the plate springs are buckled again via the exertion of pressure on the two bows 509. As FIG. 5 shows, the top edges of the two plate springs 51 in the use position are jagged and they thus cling to the annular ridge of the bottleneck and provide a secure hold.

In the base body 30 of the stopper S there is an essentially tubular valve housing 33 having a flange 34 which protrudes inwards. In the bottom end of the valve housing 33 a flow pipe 42 is tightly mounted which communicates with the valve housing 33 and which protrudes through the elastic stopper 31 up to a little below the level of the plate springs 51 into the bottleneck. The diameter of the flow pipe 42 is a little smaller than the internal diameter of the elastic stopper 31 so that a ring channel 45 remains open between the flow pipe 42 and the elastic stopper 31. Alternatively, corresponding axially parallel straight-way channels may also be provided in the elastic stopper 31.

Inside of the valve housing 33 there is a valve body 43 which is pressed upwards by a helical spring 44 resting on the flow pipe 42. The inwards protruding flange 34 of the valve housing 33 forms a valve seat which is counterpart to the valve body 43. The valve body 43 reaches with a cylindrical prolongation 43*a*, which has a slightly smaller diameter, through the flange 34 and protrudes (in the rest position) a little out of its front surface (FIG. 1). Below the cylindrical prolongation 43*a* the valve body 43 has a conical section which cooperates with the valve seat area of the flange 34. Below that conical section the valve body 43 is prismatic and has, for example, a square or hexagonal cross section so that free flow cross sections remain open in this area between the valve body and the internal wall of the valve housing 33.

The flange 34 of the valve housing 33 and the valve body 43 together form an inlet valve operating as a non-return valve through which, when open (FIG. 2), gas can be introduced into the beverage bottle F, the valve housing 33 and the flow pipe 42 fixed thereto forming an inlet channel leading through the stopper S in which the inlet valve sits and through which the supplied gas streams.

In the upper area of the valve housing 33 there is between that valve housing and the internal wall of the base body 30 a ring channel 41 which is open towards the outside (the top) and immediately below this there is a ring channel 39 which has a slightly larger diameter. On the outside of the valve housing 33 an elastic valve disk 40 is clamped which cooperates as a valve seat with the ring shoulder formed by the different diameters of the two ring channels 39 and 41 and which in the normally closed state (FIG. 1) separates the ring channel 39 from the ring channel 41 lying above it and which in the open state (FIG. 2) connects the ring channel 39 with the ring channel 41.

In the base body 30, there are axially parallel channels 36 and radial channels 37, and in the flow pipe 42 there are also radial channels 38. These radial channels 38 and 37 as well as the axially parallel channels 36 connect the ring channel 45 in the elastic stopper 31 communicatingly with the ring channel 39 below the elastic valve disk 40.

The ring channel 45 lying between the flow pipe 42 and the internal wall of the elastic stopper 31, the radial channels 38 in the flow pipe 42, the radial channels 37 in the base body 30, the axially parallel channels 36 in the base body 30, the ring channel 39 and the ring channel 41 together form an outlet channel leading through the stopper. The outlet valve formed by the elastic valve disk 40 normally (rest position, FIG. 1) blocks the outlet channel. When the outlet valve is opened from the outside (FIG. 2), air or gas can escape or be withdrawn from the inside of the beverage bottle F through the outlet channel. Because the ring shoulder between the two ring channels 39 and 41 is a little lower than the elastic valve disk 40, it is slightly prestressed elastically and seals securely. As soon as there is an overpressure in the bottle, the valve disk 40 gets pressed even more strongly against the ring shoulder which further increases the sealing effect.

Those parts of the stopper S which form the inlet channel and the outlet channel have such dimensions that the free flow cross section of the outlet channel is at every point larger, preferably by a factor >2, than the smallest free flow cross section of the inlet channel.

The functioning or operating mode of the apparatus is as follows:

While temporarily buckling the two plate springs 51 apart, a stopper S according to this invention is placed on a part-filled wine or champagne bottle F the contents of which are to be preserved, the elastic stopper 31 being introduced into the bottleneck where it wedges in a sealing fashion by means of its sealing ribs 32 (FIG. 1).

Together with the stopper S fixed on or in it, the bottle F is now approached to the charge head H, which is fixedly mounted at a suitable place, such that the upper front surface of the stopper S rests against the mounting block 20. The collar 23 of the mounting block 20 then penetrates on the one hand into the ring channel 41 and on the other hand the prolongation 11 of the charging pipe 10 penetrates into the flange 34 of the valve housing 33. The ram 29*a* is furthermore shifted upwards, which actuates the switch 29 (FIG. 2).

The joint ring 12 seals together with the flange 34 of the valve housing 33, and the circumferential joint ring 25 seals together with the external wall of the ring channel 41 in the stopper S.

The collar 23 of the mounting block 20 which has penetrated into the ring channel 41 presses the elastic valve disk 40 downwards, thus opening the outlet valve of the stopper S.

The prolongation 11 of the charging pipe 10 which has penetrated into the flange 34 presses the valve body 43 downwards and inwards, thus opening the inlet valve of the stopper S.

The outlet channel in the stopper S and the venting channel in the charge head H are now in communicating connection and are sealed against the environment. Analogously, the charging pipe 10 and the inlet channel in the stopper S are communicatingly connected and sealed against the environment.

Triggered by the upward movement of the ram 29*a* and by the actuation of the switch 29 effected thereby, the control 4 now opens the inlet valve 1 and the vent valve 2 at the same time. From the gas source 3 or from the corresponding connection, nitrogen or another food-compatible gas which is under a relatively small overpressure of about 100 kPa (1 bar), preferably of about 140 kPa (1.4 bar), now streams through the charging pipe 10 and the inlet channel of the stopper S into the bottle F. At the same time the gas streaming into the bottle expels the gas which is in the bottle, usually normal oxygen-containing ambient air, into the environment via the outlet channel in the stopper S and via the venting channel in the charge head. After a first time span of e.g. about 5 s the control 4 closes the vent valve 2. As the inlet valve 1 is still open, gas continues to stream into the bottle thus building up a slight overpressure in the bottle which is registered by the pressure sensor 4*a* and transmitted to the control 4. When a preset required pressure of e.g. about 80 kPa (0.8 bar) is reached, which is normally the case after about another second, the inlet valve 1 is closed again by the control 4. Alternatively, the closing of the inlet valve 1 can also be carried out in a time-controlled way by the control 4.

The bottle F with its stopper S is now separated again from the charge head H by a downward movement. This automatically closes the outlet valve and the inlet valve in the stopper again. However, as this, depending on the speed of the manual movement, still takes a brief moment, some of the gas escapes again from the bottle and a slightly smaller overpressure of c. 20 to 50 kPa (0.2 to 0.5 bar) finally establishes above the liquid level in the bottle. Experience shows, however, that in conjunction with the removal of the residual oxygen from the bottle this overpressure suffices to achieve the preservation of the quality of the bottle contents at least in the case of wine and champagne or sparkling wine.

It is of course also possible to produce a higher overpressure in the bottle. In practice, however, more than 300 kPa (3 bar) are not required.

The overpressure in the bottle can later be released before the stopper S is removed by opening the inlet valve. To do so it is only necessary to press the button-shaped prolongation 43*a* of the valve body 43 protruding from the front end of the stopper inwards by hand, through which the inlet valve opens and the overpressure can depressurise via the inlet channel without danger and without any disturbing noise.

The gas source 3 used may be a commercially available gas bottle, preferably a nitrogen bottle, fitted with a corresponding pressure reducing valve. The electric control 4 required for the operating sequences can be realised with very simple means and the person skilled in the art requires no detailed instructions. The control 4 could, of course, also be pneumatic and the gas source could then also provide the driving force for the pneumatic control. In the case of a pneumatic control, the triggering of the operating sequences of the control (opening and pressure- or time-controlled closing of the inlet valve and vent valve) can be carried out in a manner known per se via mechanical coupling of a control valve with the ram 29.

The inventive apparatus is capable of maintaining a constant overpressure of 20 to 300 kPa (0.2 to 3 bar) over a period of at least 120 hours in the bottle and can thus warrant the quality preservation of the contents of the bottle for at least that same period of time.

The second embodiment of the inventive apparatus depicted in the drawings 3 and 4 differs from the embodiment of the drawings 1 and 2 only through the structure of the inlet valve of the stopper S. Instead of the spring-loaded valve body 43, a stopper 143 is mounted in coaxially movable manner in the upper end of the flow pipe 142. The stopper 143 is provided with a sealing disk 143*b* which cooperates with the inwards protruding flange 34 of the valve housing 33 and which forms the inlet valve together with it. A button-shaped prolongation 143*a* of the stopper 143 protruding through the flange 34 has the same function as the corresponding prolongation 43*a* of the valve body 43 in the embodiment shown in the drawings 1 and 2. All other components of this embodiment of the inventive apparatus are identical to those of the embodiment shown in the drawings 1 and 2 and are therefore provided with the same reference marks.

What is claimed is:

1. An apparatus for preserving the contents of a part-filled beverage bottle with a stopper for the beverage bottle, comprising:

an inlet channel and an inlet valve which is arranged therein and which is a closed non-return valve when at rest;

a charging device which is provided with a charge head for connection to a gas source, to which charge head the stopper can be communicatingly coupled and by means of which charging device a gas can be introduced into the beverage bottle via the charge head through the inlet valve of the stopper, the charge head opening the inlet valve when the stopper is coupled;

the stopper including an outlet channel and an outlet valve which is arranged therein and which is a closed non-return valve when at rest, wherein the charge head is equipped for opening the outlet valve when the stopper is coupled;

in the charge head, a venting channel which can be closed via a vent valve is communicatingly connected to the outlet channel of the stopper when the stopper is coupled to the charge head; and a control which, during or after the coupling of the stopper to the charge head, opens the outlet valve for a first time span, such that an interior of the beverage bottle is connected with an exterior via the outlet channel, the venting channel and the vent valve.

2. An apparatus according to claim 1, wherein the charging device is provided with a charging device inlet valve and during or after the coupling of the stopper to the charge head, the control opens the charging device inlet valve for a second time span, the gas to be introduced into the beverage bottle streaming from the gas source via the charging device inlet valve, the charge head and the stopper into the beverage bottle.

3. An apparatus according to claim 2, wherein the control opens the charging device inlet valve and the vent valve essentially at the same time.

4. An apparatus according to claim 2, wherein the first time span during which the vent valve is opened is shorter than the second time span during which the charging device inlet valve is opened.

5. An apparatus according to claim 2, wherein the second time span is about 6 s.

6. An apparatus according to claim 2, wherein the first time span during which the vent valve is opened is shorter than the second time span during which the charging device inlet valve is open.

7. An apparatus according to claim 1, wherein the gas is nitrogen.

8. An apparatus according to claim 7, wherein the gas is under an overpressure in a range of 100 kPa (1 bar).

9. An apparatus according to claim 8, wherein the overpressure is about 80 kPa (0.8 bar).

10. An apparatus according to claim 1, wherein the first time span is about 5 s.

11. An apparatus according to claim 1, comprising:

a pressure sensor which cooperates with the control for the pressure in the beverage bottle, wherein the control closes the inlet valve when the pressure in the beverage bottle reaches a predetermined pressure.

12. An apparatus according to claim 1, wherein the stopper includes elastic devices to warrant its fixation to the beverage bottle.

13. An apparatus according to claim 3, wherein the gas is nitrogen.

14. A stopper according to claim 1, comprising:

elastic devices for warranting its fixation to the beverage bottle.

15. A stopper for a beverage bottle comprising:

an inlet channel, which permeates the stopper and ends at a front end of said stopper;

an inlet valve which is arranged in the inlet channel and which is a non-return valve when at rest and which can be opened from outside;

an outlet channel, which permeates the stopper and ends at the front end of said stopper; and an outlet valve which is arranged in the outlet channel and which is a non-return valve when at rest and which can be operated from outside the stopper.

16. A stopper according to claim 15 comprising:

a flow pipe which communicates with the inlet channel or which is a part thereof and which protrudes into a neck of the beverage bottle.

17. A stopper according to claim 16 wherein the valve body of the outlet valve is a prestressed elastic ring disk.

18. A stopper according to either claim 15, wherein the valve body of the outlet valve is a prestressed elastic ring disk.

* * * * *